United States Patent [19]

Guex

[11] 4,286,677

[45] Sep. 1, 1981

[54] HELICAL IMPACT BIT FOR DRILLING STONE WITH NARROW GUIDE LIPS

[75] Inventor: Raymond Guex, Nyon, Switzerland

[73] Assignee: Guex and Fils S.A., Nyon, Switzerland

[21] Appl. No.: 79,541

[22] Filed: Sep. 27, 1979

[30] Foreign Application Priority Data

Sep. 28, 1978 [CH] Switzerland ..... 10115/78

[51] Int. Cl.[3] ..... E21B 10/44

[52] U.S. Cl. ..... 175/395; 408/230

[58] Field of Search ..... 175/394, 395; 408/230

[56] References Cited

U.S. PATENT DOCUMENTS

| | | | |
|---|---|---|---|
| 3,548,688 | 1/1969 | Kuch | 408/230 |
| 3,845,829 | 11/1974 | Schaumann | 175/395 |

FOREIGN PATENT DOCUMENTS

| | | | |
|---|---|---|---|
| 446240 | 3/1968 | Switzerland | 175/394 |
| 1185094 | 3/1970 | United Kingdom | 175/394 |

*Primary Examiner*—Ernest R. Purser

*Attorney, Agent, or Firm*—Robert E. Burns; Emmanuel J. Lobato; Bruce L. Adams

[57] ABSTRACT

The bit for drilling stone for use in a hammer drill or an electric hammer comprises a body defining recesses which, in axial section, have a profile at least approximately in the form of an arc of a circle with a radius of between approximately 8 mm and 15 mm. The ratio of the surface area of guide lips each located between two of the recesses in the body of the bit and of the outer cylindrical surface defined by the bit is less than 5%, and preferably of the order of 1 to 2%. The diameter of a tip of the bit, which is provided with a plate of hard metal is equal to the diameter of said cylindrical surface in the vicinity of the plate.

5 Claims, 4 Drawing Figures

HELICAL IMPACT BIT FOR DRILLING STONE WITH NARROW GUIDE LIPS

FIELD OF INVENTION

The present invention relates to a bit for drilling stone, which bit can be used with a hammer drill or an electric hammer.

The invention is intended to apply to bits of small diameter, of approximately 5 to 12 mm in particular, especially those for inserting wall bolts, since the problems which occur are different for these bits of small diameter than for those of diameter greater than 12 mm and cannot be resolved by the same means.

BACKGROUND OF THE INVENTION

Bits for drilling stone which are in current use have deep recesses with a circular profile having a steep curvature similar to the profile of the recesses in bits used for drilling metal. In order to ensure that these bits have adequate strength, the guide lips or rims therefor are necessarily relatively wide, their surface representing approximately 50% of the surface of the cylindrical casing of the bit. If the strength and guidance of the bit is adequate, then the frictional surface tends to be considerable, which causes rapid and excessive heating. Furthermore, the waste material, which occurs above all in the form of a powder with grains of varying size, tends to remain trapped in the recesses which are relatively narrow and deep, causing clogging, increasing the heating of the bit and the rotary torque and consequently the heating of the machine driving the bit, which consequently limits the operating speed, i.e. the speed of stone penetration. Fracture of the bit may also occur because it is subject to excessive torsional stress.

It has been proposed to improve the efficiency of these bits by reducing the width of the lips and by using recesses of quasi-rectangular trapezoidal profile, for example see West German Pat. No. 23 58 447. In order to ensure the mechanical strength of the bit, the width of the lips is still relatively great and the depth of the recesses relatively slight. Furthermore, dust tends to remain in the slightly rounded angles at the bottom of the recesses. However, these bits make it possible to increase the operating speed, i.e. the penetration speed, by approximately 30%.

Special profiles have been studied in order to improve the efficiency of bits having a diameter greater than 12 mm. However, these profiles cannot be used on bits of small diameters, since the strength of the body of the bit would be much too low.

SUMMARY OF THE INVENTION

The object of the present invention is to increase the operating speed without placing further stress on the bit or reducing its life expectancy.

According to the present invention there is provided a bit for drilling stone for use in a hammer drill or an electric hammer, comprising a tip having a diameter with a value within the range of 5 to 12 mm inclusive, a plate of hard metal provided at the tip of the bit, a cylindrical body defining a plurality of recesses for the evacuation of waste material produced during drilling, the body in axial section defining the recesses such that the latter have a profile at least approximately in the form of an arc of a circle with a radius having a value within the range of 8 mm to 15 mm inclusive according to the diameter of said cylindrical body, and a plurality of guide lips forming a part of said cylindrical body and each located between two of said recesses, the guide lips defining a surface area which forms a part of the outer cylindrical surface defined by the body, the ratio of which surface area to said cylindrical surface itself being less than 5%.

This invention reduces the friction that is encountered by the bit, the effect of which would otherwise reduce the torque necessary for driving the bit, and makes it possible to increase the operating speed by approximately 50% with respect to conventional bits. The extended arcuate profile and the volume of the recesses prove very favourable for the evacuation of waste material. Furthermore, the connection between the shape of the recesses and the original cylinder of the bit is harmonious and has no apparent weakness. The fact that the ratio between the minimum diameter of the core and the outer diameter of the cylindrical casing of the bit still has a value of 0.6 to 0.65 shows that the bit has a profile of great strength. This ratio is substantially greater than that existing in conventional bits.

Preferably, the depth of the recesses decreases from the tip along the body of the bit. This increases the mechanical strength of the bit. Furthermore, the plate of hard metal preferably does not project beyond the said outer cylindrical surface of the bit, as is the case in known bits. This is possible owing to the very slight width of the lips. This latter feature provides several advantages: reinforcing the support behind the small plate and over its entire height; better guidance and better cylindricity of the drilled hole; uniformly distributed discharge volume for the waste material; and a junction with the helical recesses which precludes any reduction in the section of passage. Furthermore, it is not necessary to provide any reduction in the depth of the recesses close to the head, as is provided in the bit according to German Pat. No. 23 58 447.

BRIEF DESCRIPTION OF DRAWING

The present invention will now be described by way of example with reference to the accompanying drawing, in which.

DESCRIPTION OF PREFERRED EMBODIMENT

Figure 1:
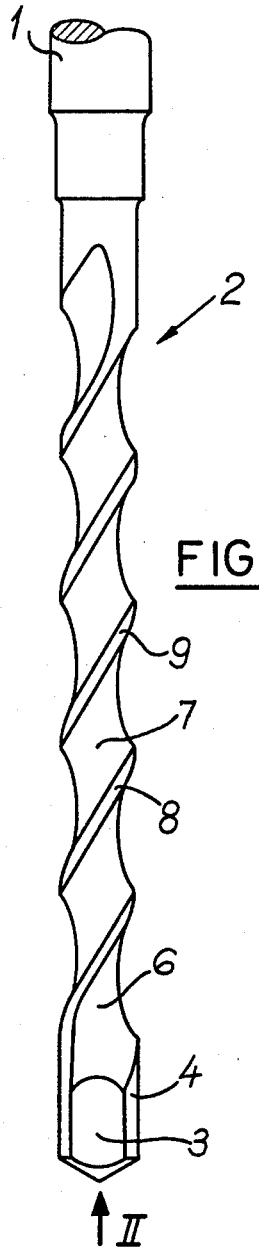
FIG. 1 is an elevational view of a bit according to the present invention.

The bit illustrated in FIG. 1 comprises a securing shank 1, a body 2 and a tip 3 provided with a small plate 4 of hard metal. This body comprises two helical recesses 6 and 7 between which extend two guide lips 8 and 9 having a cylindrical surface coinciding with the cylindrical casing 5 of the bit. The angle of the helix with respect to the axis of the bit is between approximately 30° and 35°. Before wear, the cylindrical surface of each of the lips 8 and 9 represents only 1 to 2% of the surface of the casing. After a certain amount of wear, this surface may reach approximately 5% of the surface of the cylindrical casing.

The bit is also characterized by a very accentuated profile of the recesses. In the axial sectional view illustrated in FIG. 3, it can be seen that the profile of the recesses is in the form of a greatly extended arc of a circle. For example, for an initial diameter of the body of the bit of 8.2 mm, the radius of curvature R of this profile is equal to 12.5 mm.

Figure 3:
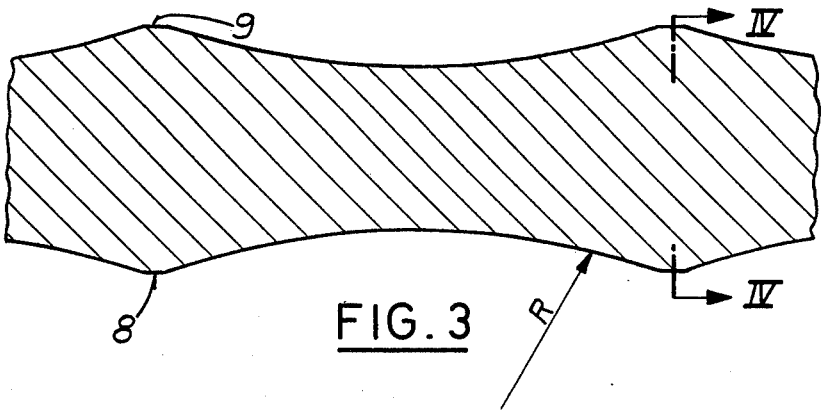
FIG. 3 is a partial longitudinal cross-sectional view of the bit of FIG. 1 but to an enlarged scale.
Figure 4:
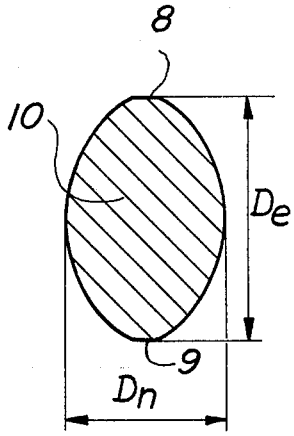
FIG. 4 is a cross-sectional view on the line IV—IV of FIG. 3.

In the cross section illustrated in FIG. 4, the minimum diameter has been shown, i.e. the diameter of the core 10 of the bit $D_n$, as well as the outer diameter $D_e$. The ratio $D_n/D_e$ is always at least equal to 0.6 and comprised between 0.6 and 0.65. Considering figures 3 and 4, it will be seen that the recesses have a shape such that the connection of this shape to the original cylinder takes place harmoniously and produces no apparent weakness. The strength of the bit is optimum. Furthermore, in order to increase the mechanical strength of the core of the bit, the depth of the recesses decreases gradually from the head towards the shank. Despite the relatively slight depth of the recesses, the volume of the latter, which is limited by the cylindrical casing of the bit, is quite sufficient to ensure evacuation of the waste material, this evacuation also being assisted by this extended arcuate profile, which comprises no corners in which the waste material would be able to accumulate. On the other hand, the very small surface of the guide lips 8 and 9 considerably reduces friction at the time of drilling.

Figure 2:
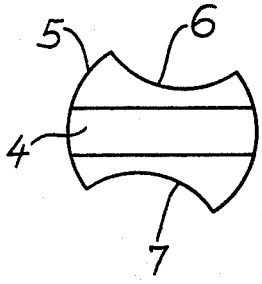
FIG. 2 is an end view of the bit looking in the direction of arrow II in FIG. 1 but to an enlarged scale.

As regards the attachment of the small hard metal plate 4, FIG. 2 shows that this plate, contrary to known designs, does not project beyond the cylindrical casing 5 of the bit. Such a construction of the head has several technical advantages which are as follows:

reinforcement of the support for the small hard metal plate, at the rear of the latter and over its entire height;

cylindricity of drilling and guidance of the bit are ensured to a much better degree;

space for evacuation of waste material is distributed symmetrically;

the junction with the helical recesses is effected perfectly without reducing the section of passage.

The optimum radius of curvature R of the recesses in longitudinal section as shown in FIG. 3 varies according to the diameter of the bit. For example, it is 9.5 mm for an initial diameter of the body of the bit of 7.5 mm, 10 mm for an initial diameter of 6.5 mm and 11 mm for an initial diameter of 10.0 mm.

What is claimed is:

1. A bit for drilling stone for use in a hammer drill or an electric hammer, comprising a tip having a diameter with a value within the range of 5 to 12 mm, a plate of hard metal provided at the tip of the bit, a cylindrical body defining two helical recesses for the evacuation of waste material produced during drilling, said helical recesses defining an angle of less than 35° to the longitudinal axis of the bit, the body in axial section defining said recesses such that all of the latter have like profiles at least approximately in the form of an arc of a circle with a radius having a value within the range of 8 mm to 15 mm according to the diameter of said cylindrical body, a core defined by said recesses and two guide lips forming a part of said cylindrical body and located between said two recesses, said guide lips defining a surface area which forms a part of the outer cylindrical surface defined by said body, the ratio of the cylindrical surface area of said lips to the total cylindrical surface of said cylindrical body being less than 5%, and the ratio between the minimum diameter of said core and the diameter of said outer cylindrical surface having a value within the range of 0.6 to 0.65.

2. A bit as claimed in claim 1, in which the radius of curvature of the profile of said recesses in axial section has a value within the range of 9.5 mm to 13 mm and said cylindrical surface area of said guide lips defines an area of 2% or less of the total area of said cylindrical surface.

3. A bit as claimed in claim 1, in which said helical recesses have an angle in the range 30° to 35° with respect to the longitudinal axis of the bit.

4. A bit as claimed in claim 1, in which the depth of the recesses decreases from said tip along the body of the bit.

5. A bit as claimed in claim 1, in which the region of said plate of hard metal, the diameter of said tip is equal to the diameter of said outer cylindrical surface of the bit body, said plate being in line with and supported throughout its full width by adjacent portions of said lips.

* * * * *

UNITED STATES PATENT AND TRADEMARK OFFICE

CERTIFICATE OF CORRECTION

PATENT NO. : 4,286,677

DATED : September 1, 1981

INVENTOR(S) : Raymond Guex

It is certified that error appears in the above—identified patent and that said Letters Patent is hereby corrected as shown below:

Cancel the title page and substitute the attached page therefor.

Jnited States Patent [19]
Guex

[11] 4,286,677
[45] Sep. 1, 1981

[54] HELICAL IMPACT BIT FOR DRILLING STONE WITH NARROW GUIDE LIPS

[75] Inventor: Raymond Guex, Nyon, Switzerland

[73] Assignee: Guex and Fils S.A., Nyon, Switzerland

[21] Appl. No.: 79,541

[22] Filed: Sep. 27, 1979

[30] Foreign Application Priority Data

Sep. 28, 1978 [CH] Switzerland ..... 10115/78

[51] Int. Cl.[3] ..... E21B 10/44
[52] U.S. Cl. ..... 175/395; 408/230
[58] Field of Search ..... 175/394, 395; 408/230

[56] References Cited

U.S. PATENT DOCUMENTS 3,548,688 1/1969 Kuch ..... 408/230
3,845,829 11/1974 Schaumann ..... 175/395

FOREIGN PATENT DOCUMENTS 446240 3/1968 Switzerland ..... 175/394
1185094 3/1970 United Kingdom ..... 175/394

*Primary Examiner*—Ernest R. Purser
*Attorney, Agent, or Firm*—Robert E. Burns; Emmanuel J. Lobato; Bruce L. Adams

[57] ABSTRACT

The bit for drilling stone for use in a hammer drill or an electric hammer comprises a body defining recesses which, in axial section, have a profile at least approximately in the form of an arc of a circle with a radius of between approximately 8 mm and 15 mm. The ratio of the surface area of guide lips each located between two of the recesses in the body of the bit and of the outer cylindrical surface defined by the bit is less than 5%, and preferably of the order of 1 to 2%. The diameter of a tip of the bit, which is provided with a plate of hard metal is equal to the diameter of said cylindrical surface in the vicinity of the plate.

5 Claims, 4 Drawing Figures

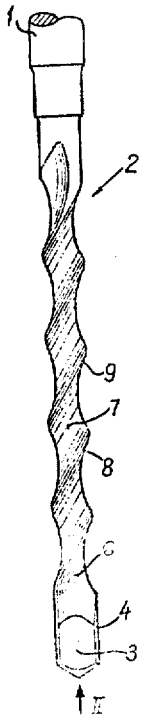

UNITED STATES PATENT AND TRADEMARK OFFICE

CERTIFICATE OF CORRECTION

PATENT NO. : 4,286,677

DATED : September 1, 1981

INVENTOR(S) : Raymond Guex

It is certified that error appears in the above—identified patent and that said Letters Patent is hereby corrected as shown below:

Cancel Figure 4 of the drawings and substitute the Figure shown below.

FIG. 4

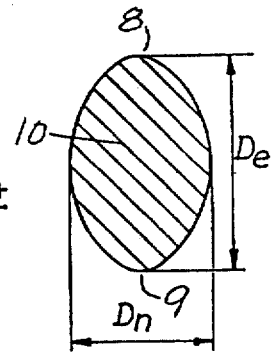

Signed and Sealed this

Sixth Day of April 1982

[SEAL]

Attest:

GERALD J. MOSSINGHOFF

Attesting Officer

Commissioner of Patents and Trademarks